US007118518B1

(12) United States Patent
Teeter

(10) Patent No.: US 7,118,518 B1
(45) Date of Patent: Oct. 10, 2006

(54) HAND GRIP FOR TILTING INVERSION EXERCISE TABLE

(76) Inventor: Roger C. Teeter, 20720 Snag Island Dr., Sumner, WA (US) 98390

( * ) Notice: Subject to any disclaimer, the term of this patent is extended or adjusted under 35 U.S.C. 154(b) by 0 days.

(21) Appl. No.: 11/201,997

(22) Filed: Aug. 11, 2005

(51) Int. Cl.
*A63B 26/00* (2006.01)

(52) U.S. Cl. ..... 482/144; 482/145

(58) Field of Classification Search ..... 482/144, 482/145; D21/685, 686, 689, 665
See application file for complete search history.

(56) References Cited

U.S. PATENT DOCUMENTS 4,232,662 A * 11/1980 Barber ..... 482/144
5,718,660 A 2/1998 Chen ..... 482/144
5,967,956 A 10/1999 Teeter ..... 482/144

FOREIGN PATENT DOCUMENTS

GB 2131305 A * 6/1984

* cited by examiner

*Primary Examiner*—Lori Amerson
(74) *Attorney, Agent, or Firm*—Charles E. Baxley

(57) ABSTRACT

A tilting inversion exerciser includes a table rotatably supported on a supporting stand for supporting a user and having one or more hand grips attached to the table and rotated in concert with the table relative to the supporting stand, for being grasped by the user to pull the user's body upwardly against gravity force, when the user is suspended above the ground. The table includes two opposite side edges each having a trunnion for rotatably attaching to the supporting stand. The table includes two hanger bars for supporting the trunnions, and the hand grip includes an end panel for securing to the trunnion with one or more fasteners.

6 Claims, 8 Drawing Sheets

HAND GRIP FOR TILTING INVERSION EXERCISE TABLE

BACKGROUND OF THE INVENTION

1. Field of the Invention

The present invention relates to a tilting inversion exercise table, and more particularly to a tilting inversion exercise table having a hand grip attached thereto and rotated in concert therewith for being held by the user while conducting the tilting inversion exercises.

2. Description of the Prior Art

Typical tilting inversion exercise tables comprise a base or table pivotally or rotatably supported on a lower support, for supporting a user thereon, and for allowing the user to tilt or to incline the table relative to the lower support, in order to conduct the typical tilting inversion exercises.

For example, U.S. Pat. No. 5,718,660 to Chen discloses one of the typical tilting inversion exercisers also comprising a base or table pivotally or rotatably supported on a lower support, a handle secured to a lever which is pivotally coupled to the table and coupled to a bracket of the table with a cable, for pulling the feet of the user, in order to straighten the spinal column.

However, the table and the user may be tilted or inclined relative to the lower support and the ground only, and may not be freely or vertically supported on the lower support, and also may not be completely perpendicular to the ground, such that the user may not be freely suspended above the ground to comfortably conduct the tilting inversion exercises.

U.S. Pat. No. 5,967,956 to Teeter discloses another typical tilting inversion exerciser also comprising a base or table pivotally or rotatably supported on a lower support, a keeper arm biased to lock the table to the lower support, and an ankle holder for anchoring or securing the feet of the user to the table, and thus for allowing the table and the user to be vertically supported on the lower support and to be completely perpendicular to the ground, such that the user may be freely suspended above the ground to comfortably conduct the tilting inversion exercises.

However, the table has no handle secured or attached thereto, and the user may not be easily moved or pulled or adjusted relative to the table, particularly when the user is freely and vertically suspended above the ground, such that the user may only be vertically supported on the lower support or freely suspended above the ground, but may not exercise his spinal column.

The present invention has arisen to mitigate and/or obviate the afore-described disadvantages of the conventional tilting inversion exercise tables.

SUMMARY OF THE INVENTION

The primary objective of the present invention is to provide a tilting inversion exercise table including a hand grip attached thereto and rotated in concert therewith for being held or grasped by the user while conducting the tilting inversion exercises, and for pulling the user's body upwardly against the gravity force, particularly when the user is supported and suspended perpendicular to the ground.

In accordance with one aspect of the invention, there is provided a tilting inversion exerciser comprising a supporting stand, and a table rotatably supported on the supporting stand for supporting a user thereon, and the table includes at least one hand grip attached thereto and rotated in concert with the table relative to the supporting stand, for being grasped by the user to pull the user's body upwardly against gravity force, when the user is suspended above the ground.

The table includes a curvature for allowing the user to bend and stretch his spinal column. The table includes an ankle holder adjustably attached thereto, for securing ankle portions of the user to the table.

The table includes two opposite side edges each having a trunnion attached thereto and rotatably attached to the supporting stand. The supporting stand includes two apex plates each having a slot formed therein for rotatably receiving the trunnions. The table includes two hanger bars attached to the side edges thereof respectively, for supporting the trunnion thereon. It is preferable, but not necessarily that the trunnion is perpendicular to the respective hanger bar, for being suitably grasped by the user particularly when the user is vertically supported or dependent above the ground.

The hand grip includes an end panel having a cavity formed therein for receiving a free end portion of the trunnion, and for securing the hand grip to the trunnion. The end panel of the hand grip includes a casing having the cavity formed therein, and at least one fastener engaged through the casing and threaded to the trunnion, for securing the hand grip to the trunnion with the fastener.

The hanger bars are attached to the two side edges of the table respectively, and the end panel of the hand grip includes at least one flap extended and bent therefrom, for engaging with either of the hanger bars, and for preventing the hand grip from rotating relative to the hanger bars and the table.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
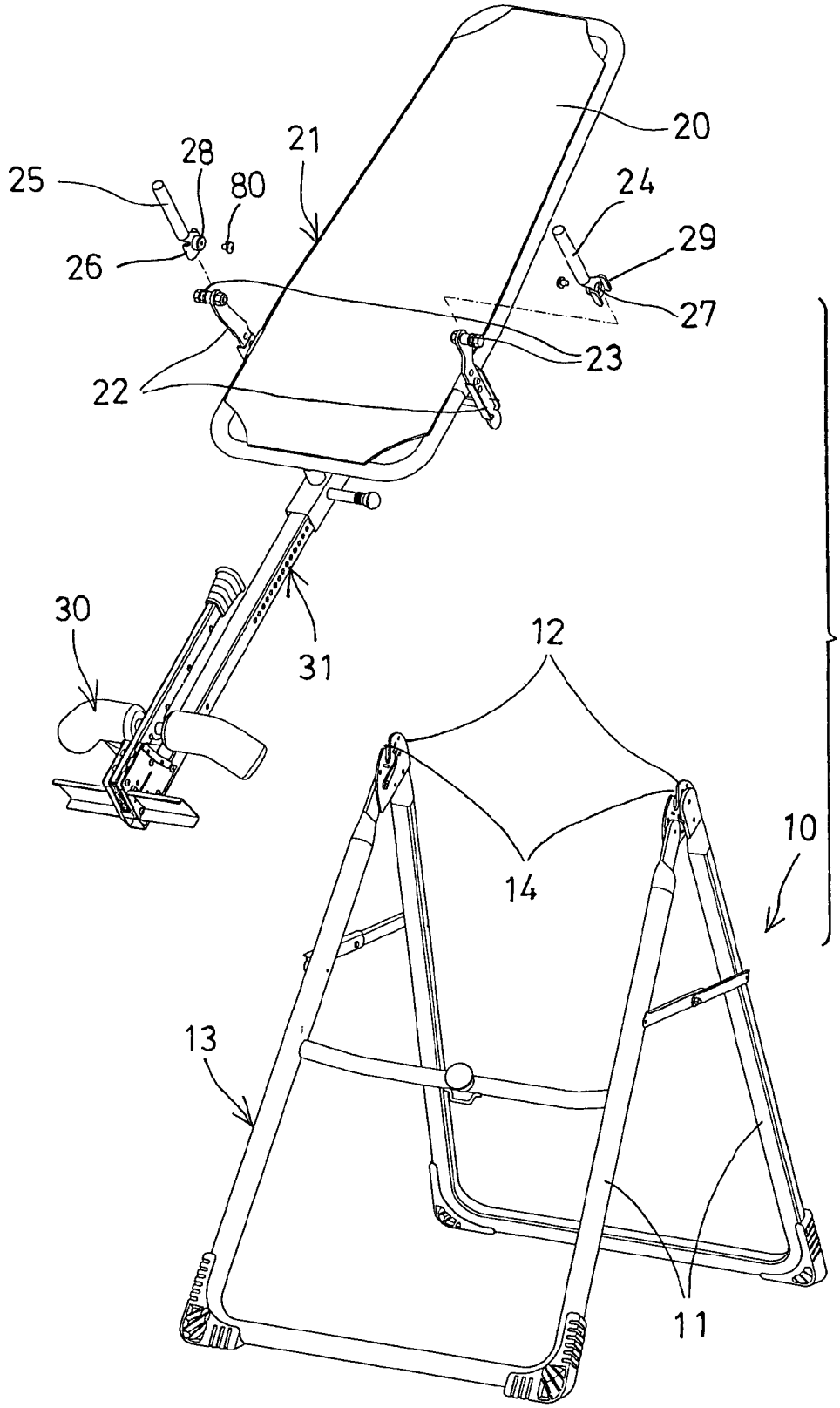
FIG. 1 is a partial exploded view of a tilting inversion exerciser in accordance with the present invention.
Figure 2:
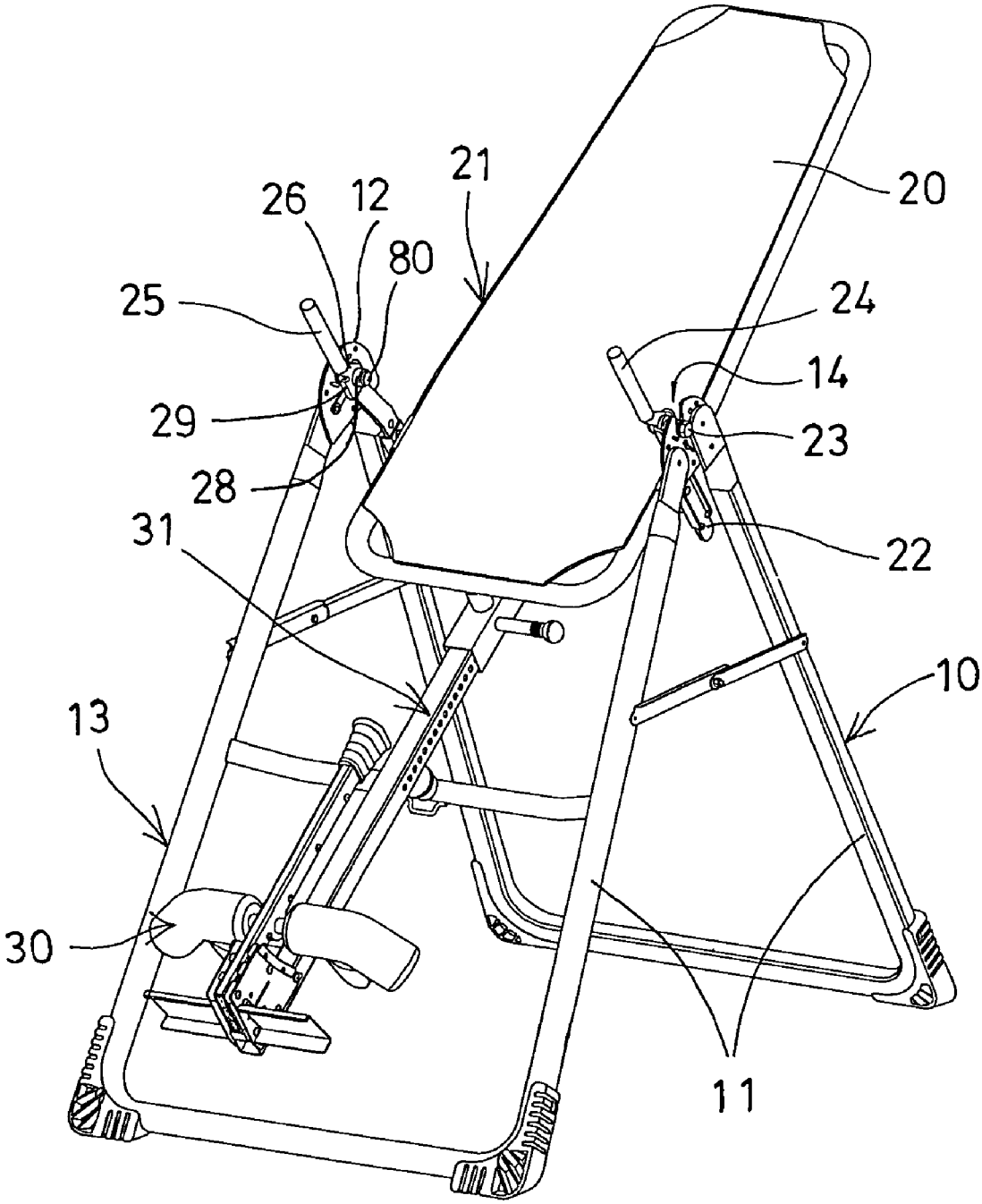
FIG. 2 is an upper perspective view of the tilting inversion exerciser.
Figure 3:
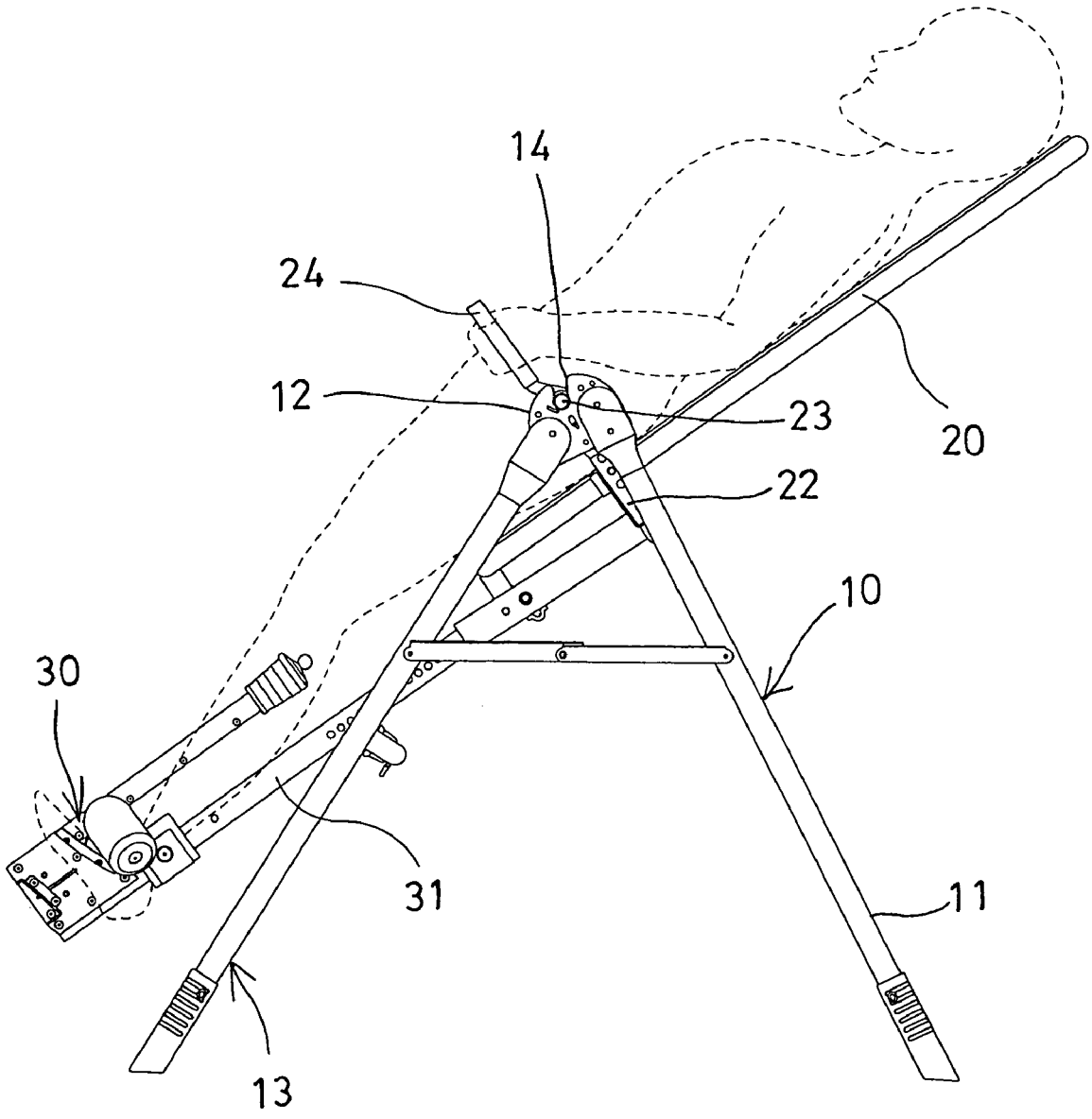
FIG. 3 is a side plan schematic view of the tilting inversion exerciser.

Referring to the drawings, and initially to FIGS. 1–3, a tilting inversion exerciser in accordance with the present invention comprises a lower supporting stand 10 for pivotally or rotatably supporting a base or table 20 thereon, and for supporting a user on the table 20 (FIGS. 3–8), the lower supporting stand 10 includes such as two pairs of legs 11 having upper ends pivotally coupled together with two apex plates 12, so as to form two A-shaped frames 13. Each of the apex plates 12 includes an upwardly opening blind slot 14 formed therein.

The table 20 includes two opposite side edges 21 each having a hanger bar 22 attached or secured thereto, and includes a trunnion 23 attached to each of the side edges 21 thereof, or provided or secured on the upper end of each of the hanger bars 22 and pivotally or rotatably engaged into or received within the upwardly opening blind slots 14 of the apex plates 12 respectively, for pivotally or rotatably attaching or supporting the table 20 on the lower supporting stand 10. The table 20 further includes an ankle holder 30 adjustably attached or secured or coupled thereto with an adjustable extension 31, for securing the ankle portions of the user to the table 20.

The lower supporting stand 10 may further include a keeper arm (not shown) biased to lock the trunnion 23 of each of the hanger bars 22 to the apex plates 12 respectively, for solidly retaining the trunnions 23 of the hanger bars 22 to the apex plates 12 respectively, and for preventing the trunnions 23 from being disengaged from the apex plates 12 respectively. The keeper arm has been disclosed in the applicant's prior U.S. Pat. No. 5,967,956 to Teeter, and will not be described in further details.

The table 20 further includes a handle or hand grip 24, 25 attached or secured to either or both of the hanger bars 22 or of the trunnions 23, and rotated in concert with the hanger bars 22 and the table 20 relative to the lower supporting stand 10. For example, as shown in FIGS. 1 and 2, each of the hand grips 24, 25 includes an end panel 26 having a cavity 27 formed therein and defined by a casing 28, for receiving a free end portion of the respective trunnion 23, and for securing to the respective trunnion 23 with such as one or more fasteners 80. For example, the fasteners 80 may be engaged through the casing 28, and may be threaded to the trunnion 23, for securing the hand grip 24, 25 to the trunnion 23 with the fasteners 80.

It is preferable that each of the hand grips 24, 25 further includes one or more, such as two flaps 29 extended or bent from the end panel 26, such as perpendicular to the end panel 26, for engaging with the hanger bars 22 respectively, and for preventing the hand grips 24, 25 from rotating relative to the hanger bars 22 and the table 20. It is also preferable, but not necessarily, that the hand grips 24, 25 are supported or disposed perpendicular to the table 20, for being suitably grasped by the user particularly when the user is vertically supported on the lower supporting stand 10 and to be completely perpendicular to the ground, best shown in FIGS. 4–5 and 7–8.

Figure 4:
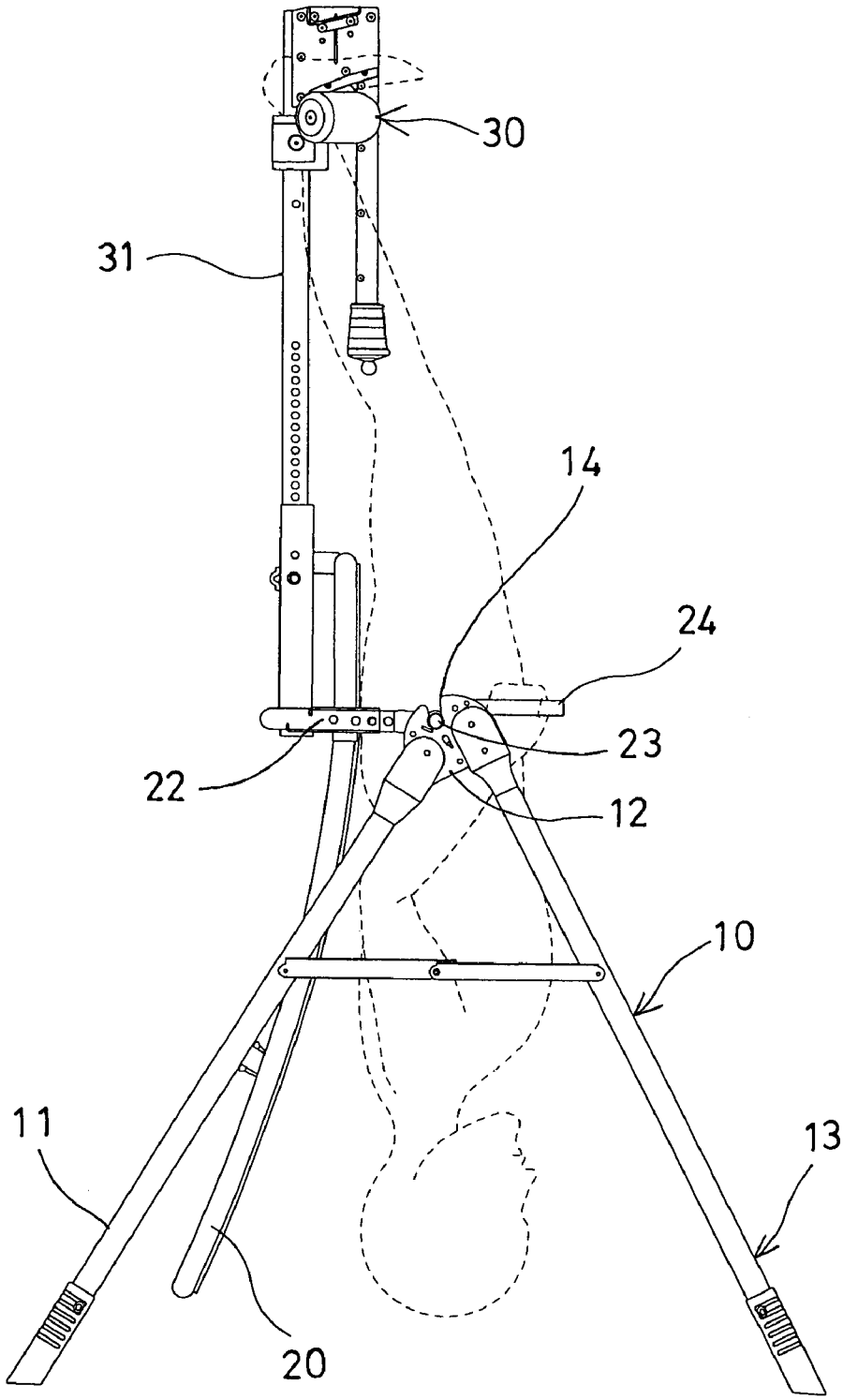
FIGS. 4, 5 are side plan schematic views similar to FIG. 3, illustrating the operation of the tilting inversion exerciser.
Figure 5:
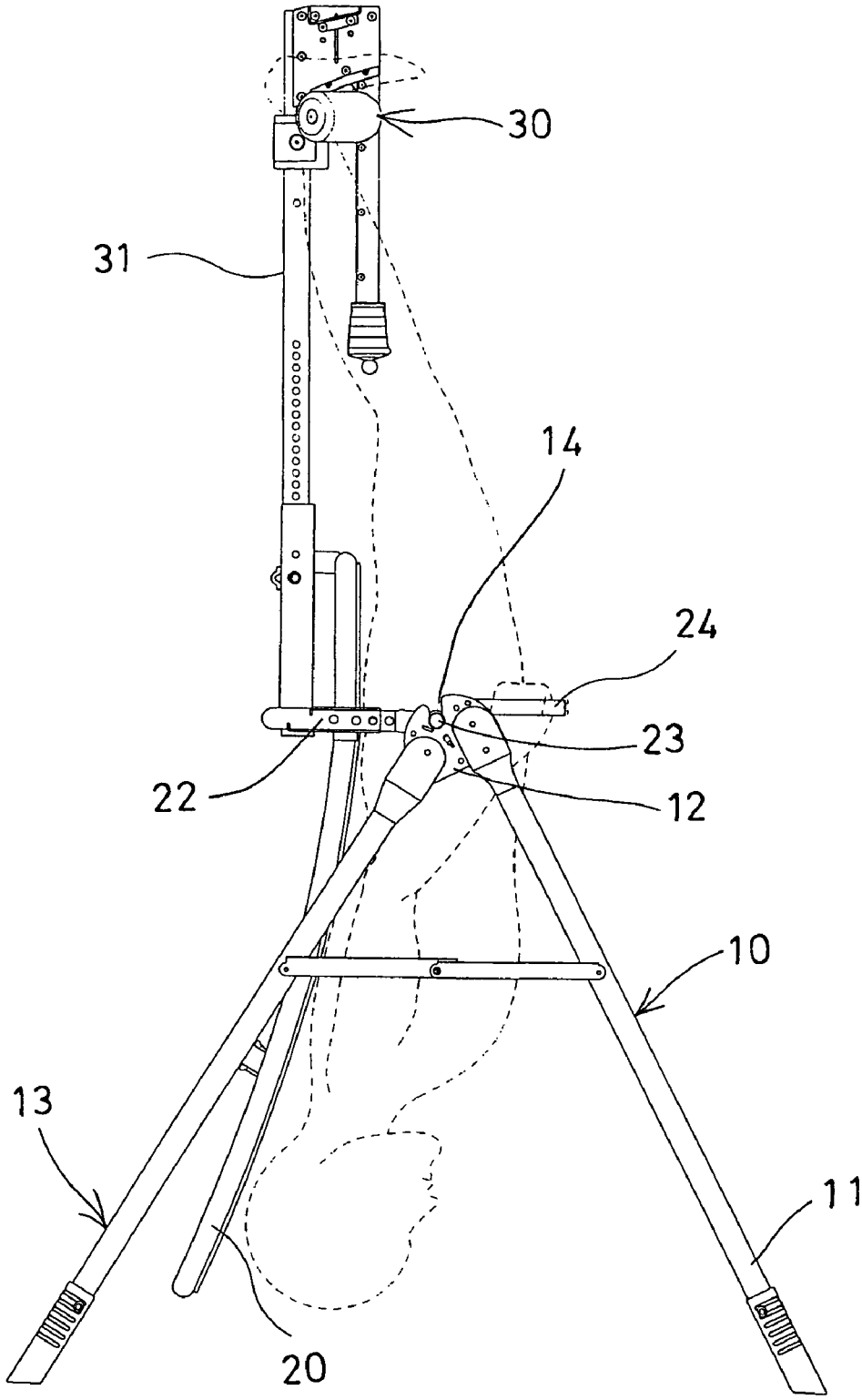

In operation, as shown in FIGS. 3–5, the user may be supported on the table 20 and may have his ankle portion detachably attached or secured to the table 20 with the ankle holder 30, for allowing the user to be completely perpendicular to the ground and to be freely suspended above the ground to comfortably conduct the tilting inversion exercises when the table is vertically supported on the lower supporting stand 10.

Figure 6:
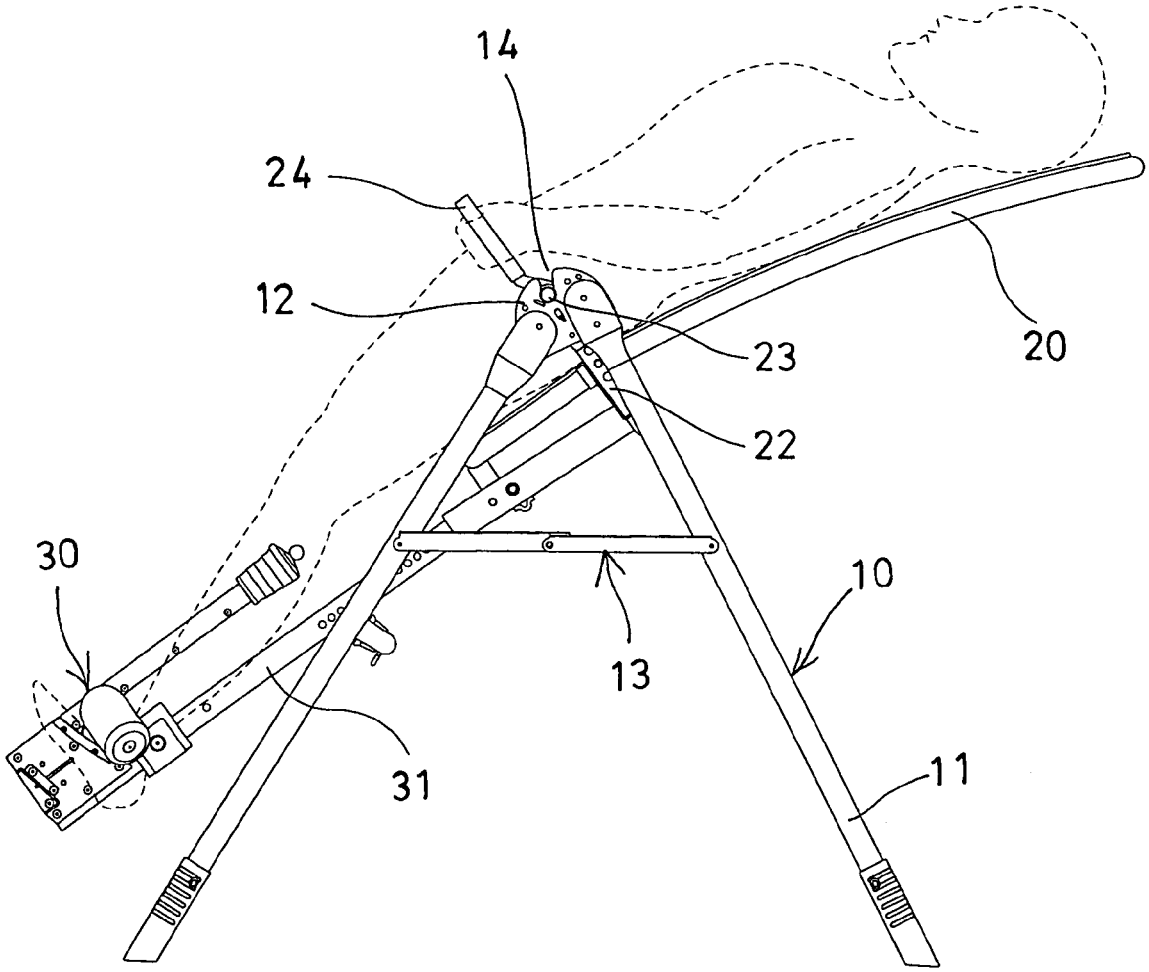
FIGS. 6, 7, 8 are side plan schematic views similar to FIGS. 3–5, illustrating the other arrangement of the tilting inversion exerciser.
Figure 7:
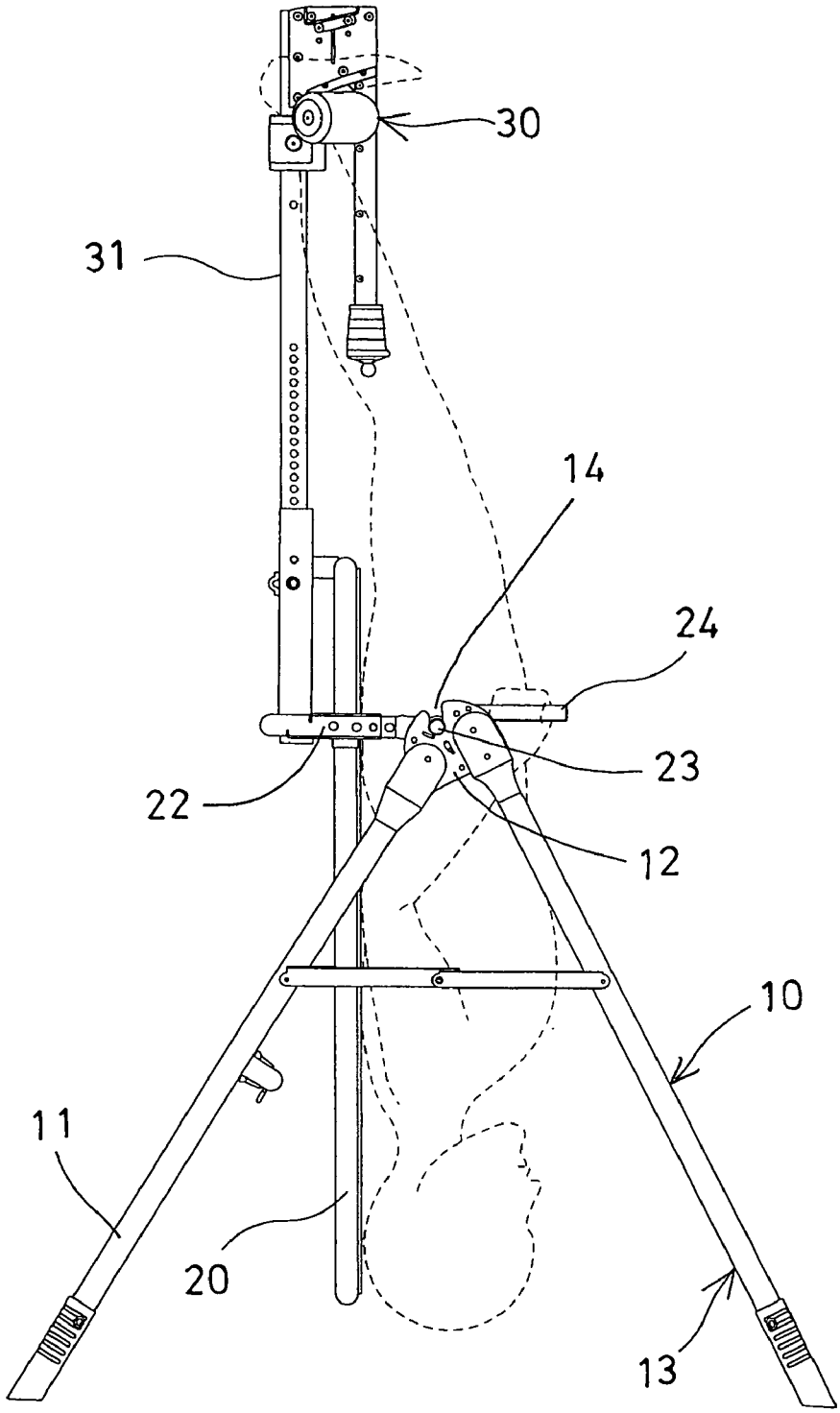
Figure 8:
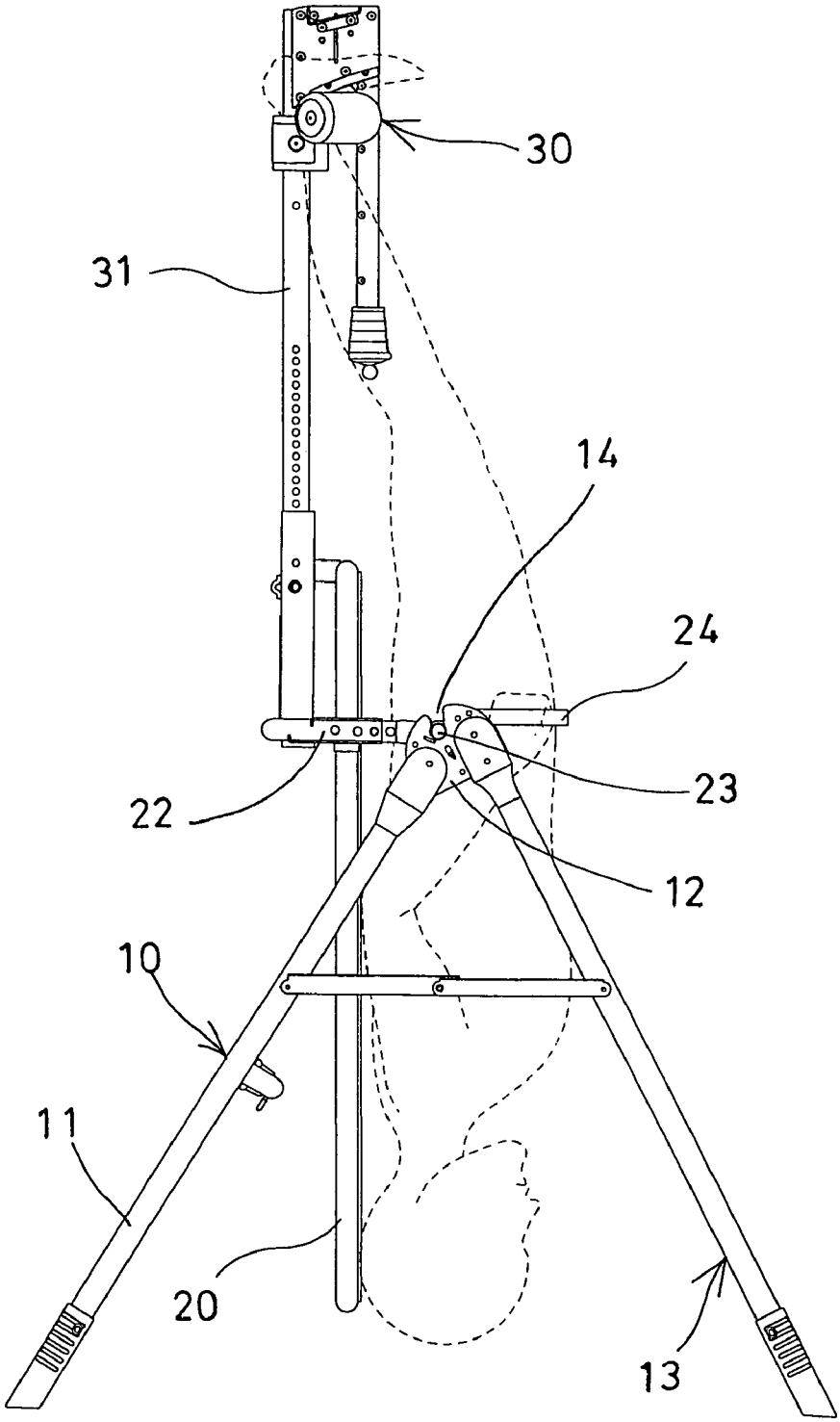

It is preferable that the table 20 includes a suitable curvature, best shown in FIGS. 3–5, for allowing the user to slightly bend or stretch his spinal column. However, as shown in FIGS. 6–8, the table 20 may also include a flat or planar structure, to flatly support the user thereon, and also to allow the user to be suspended and perpendicular to the ground.

In addition, as best shown in FIGS. 4–5, and 7–8, the user may grasp the hand grips 24, 25 to pull his body upwardly against the gravity force, particularly when the user is vertically supported on the lower supporting stand 10 and suspended perpendicular to the ground, in order to retract or to exercise his spinal column, when required, or to suitably control the extension or the stretching of his spinal column, and to prevent his spinal column from being completely stretched.

Accordingly, the tilting inversion exerciser in accordance with the present invention includes a hand grip attached to the table and rotated in concert with the table, for being held or grasped by the user while conducting the tilting inversion exercises, and for pulling the user's body upwardly against the gravity force, particularly when the user is supported and suspended perpendicular to the ground.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a supporting stand, and a table rotatably supported on said supporting stand for supporting a user thereon, said table including two opposite side edges each having a trunnion attached thereto and rotatably attached to said supporting stand, said table including two hanger bars attached to said side edges thereof respectively, and said table including at least one hand grip attached thereto and rotated in concert with said table relative to said supporting stand, for being grasped by the user to pull the user's body upwardly against gravity force, when the user is suspended above the ground, said at least one hand grip including an end panel having a cavity formed therein for receiving a free end portion of said trunnion, and for securing said at least one hand grip to said trunnion, and said end panel of said at least one hand grip including at least one flap extended and bent therefrom, for engaging with either of said hanger bars, and for preventing said at least one hand grip from rotating relative to said hanger bars and said table.

2. The tilting inversion exerciser as claimed in claim 1, wherein said table includes a curvature for allowing the user to bend and stretch his spinal column.

3. The tilting inversion exerciser as claimed in claim 1, wherein said table includes an ankle holder attached thereto, for securing ankle portions of the user to said table.

4. The tilting inversion exerciser as claimed in claim 1, wherein said supporting stand includes two apex plates each having a slot formed therein for rotatably receiving said trunnions.

5. The tilting inversion exerciser as claimed in claim 1, wherein said table includes two hanger bars attached to said side edges thereof respectively, for supporting said trunnion thereon.

6. A tilting inversion exerciser comprising:

a supporting stand, and a table rotatably supported on said supporting stand for supporting a user thereon, said table including two opposite side edges each having a trunnion attached thereto and rotatably attached to said supporting stand, and said table including at least one hand grip attached thereto and rotated in concert with said table relative to said supporting stand, for being grasped by the user to pull the user's body upwardly against gravity force, when the user is suspended above the ground, said at least one hand grip including an end panel having a cavity formed therein for receiving a free end portion of said trunnion, and for securing said at least one hand grip to said trunnion, said end panel of said at least one hand grip including a casing having said cavity formed therein, and at least one fastener engaged through said casing and threaded to said trunnion, for securing said at least one hand grip to said trunnion with said at least one fastener.

* * * * *